United States Patent [19]

Robinson et al.

[11] 4,095,441

[45] Jun. 20, 1978

[54] KNITTING METHOD

[75] Inventors: Frank Robinson; Nigel Stephen Whatmough, both of Breatsòn, England

[73] Assignee: Courtaulds Limited, London, England

[21] Appl. No.: 817,704

[22] Filed: Jul. 21, 1977

[30] Foreign Application Priority Data

Aug. 10, 1976 United Kingdom ..... 33208/76

[51] Int. Cl.[2] ..... A41B 9/06

[52] U.S. Cl. ..... 66/176

[58] Field of Search ..... 66/175, 60, 176, 64

[56] References Cited

U.S. PATENT DOCUMENTS

| | | | |
|---|---|---|---|
| 294,637 | 3/1884 | Kreisel | 66/176 |
| 404,229 | 5/1889 | Scott | 66/176 |
| 412,055 | 10/1889 | Williams | 66/176 |
| 3,057,178 | 10/1962 | Konklin | 66/176 |
| 3,474,643 | 10/1969 | Robinson et al. | 66/176 X |
| 3,664,156 | 5/1972 | Betts et al. | 66/176 |
| 3,985,003 | 10/1976 | Reed | 66/176 |

FOREIGN PATENT DOCUMENTS

| | | | |
|---|---|---|---|
| 435,308 | 11/1974 | U.S.S.R. | 66/176 |

*Primary Examiner*—Ronald Feldbaum

*Attorney, Agent, or Firm*—Davis, Hoxie, Faithfull & Hapgood

[57] ABSTRACT

A method of knitting a blank for making up into a sleeved garment includes the step of knitting fabric to form the sleeves and the front and rear body shoulder regions of the garment by forming knitted courses each of which extends the full length of each sleeve and across one of these body shoulder regions. Subsequent to, or prior to, this step, body fabric for the blank is knitted by forming simultaneously front and rear body portions of the blank by knitting courses which extend across these body portions in the finished garment, the body fabric being integral with the sleeve and body shoulder region fabric and having knitted wales which are continuous with knitted wales in the front and rear body shoulder regions.

Different ways of performing the method on a knitting machine with opposed beds are described, with knitting commencing either at the upper edge line of each sleeve and the upper shoulder line of the body of the blank or at an underarm line in the blank.

6 Claims, 2 Drawing Figures

KNITTING METHOD

Figure 1:
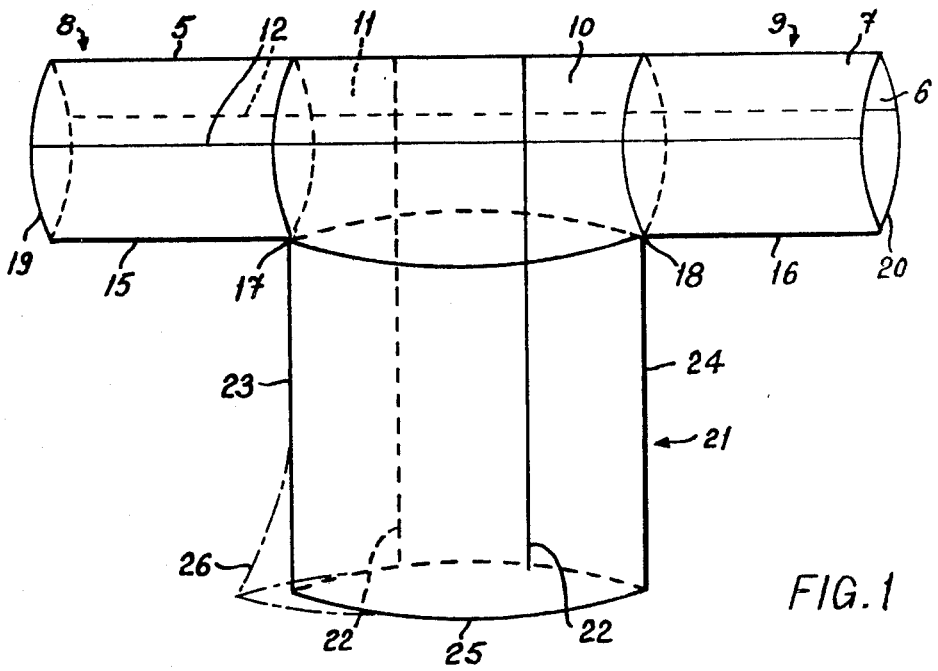

This invention relates to a method of knitting a sleeved garment blank in one piece and to the garment made from the blank.

In the methods of manufacturing garments conventionally used in the knitting industry at present, separate garment panels are knitted and are subsequently seamed together to make a garment. The present invention provides a way of simplifying this manufacturing process by knitting the garment in one piece, so that little seaming and finishing is required, thereby enabling garments to be made more cheaply and using less labour than required when employing conventional garment manufacturing procedures.

According to the invention, a method of knitting a blank for a sleeved garment comprises the step of knitting fabric to constitute the sleeves and the front and rear body shoulder regions of the garment by forming knitted courses each of which extends the full length of each sleeve and across one of said body shoulder regions, and subsequently, or prior to said step, knitting body fabric for the blank by forming simultaneously front and rear body portions of the blank by knitting courses which extend across said body portions in the finished garment, said body fabric being integral with said sleeve and body shoulder region fabric and having knitted wales which are continuous with knitted wales in said front and rear body shoulder regions.

The invention also includes a garment blank comprising fabric constituting sleeves and the front and rear body shoulder regions of the garment and having knitted courses each of which extends the full length of each sleeve and across one of said body shoulder regions, and also comprising body fabric integral with said sleeve and body shoulder region fabric, knitted in tubular form, constituting front and rear body regions of the garment, and having knitted wales continuous with knitted wales of said front and rear body shoulder regions.

Further aspects of the invention are a garment blank produced by the method described above and a garment made from such a blank or from a garment blank as described in the preceding paragraph. A knitted course may be formed in the blank extending along the upper edge line of each sleeve and across the upper shoulder line of the body whereby no seam is required along these lines.

Knitting of the garment blank may be performed on a knitting machine having opposed needle beds. Using such a machine, knitting may be started with a course of rib knitting intended to lie, in the finished garment, along the upper edge line of each sleeve and across the upper shoulder line of the body, knitting then being continued by forming a separate piece of fabric on each of the opposed needle beds to constitute front and rear fabrics of the sleeve and fabric of the front and rear shoulder regions of the body. At the arm pit level in the blank, knitting of the main part of the garment body is begun and is carried out by knitting the body in the form of a tube and in continuation of wales of the body shoulder regions.

In an alternative procedure, knitting is begun at an underarm line in the blank whereafter a piece of fabric constituting the front or rear of each sleeve and the corresponding shouder region of the body is formed, followed by the other surface of each sleeve and again the corresponding body shouder region. Thereafter knitting of the main part of the body is begun at the arm pit level in the blank and is carried out by knitting the body in the form of a tube and in continuation of wales of the body shoulder region.

Figure 2:
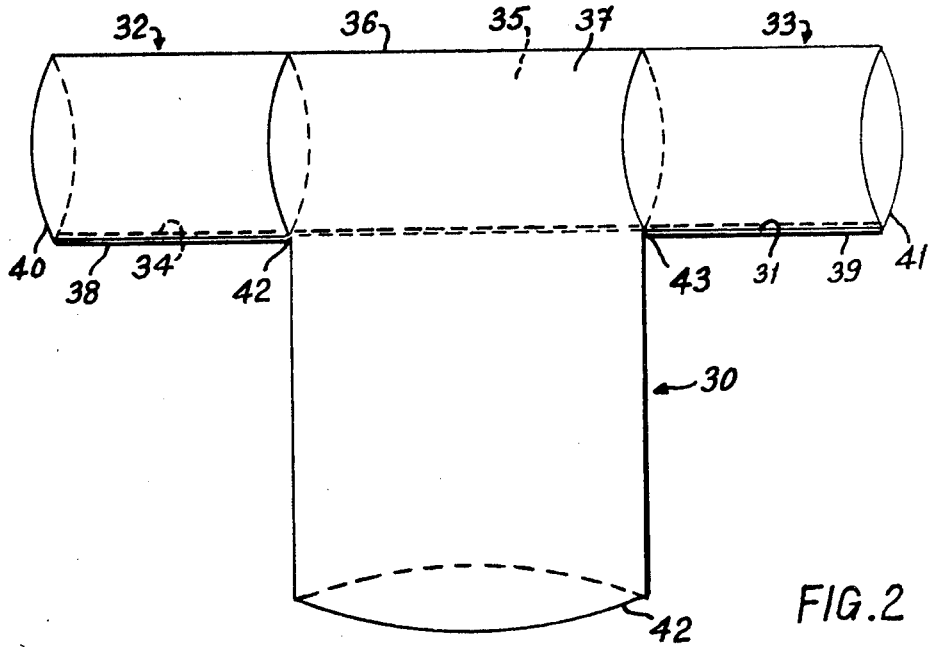

The invention will be further described, by way of example, with reference to the accompanying drawing, in which FIGS. 1 and 2, illustrate two different procedures of manufacturing a garment blank by the method of the invention.

The knitting procedures illustrated in the drawing are carried out on a knitting machine having opposed needle beds, and in which knitting can be stopped on some needles and loops held on those needles, whilst adjacent needles continue to knit. An example of such a machine is the flat V-bed machine produced by the firm of Edouard Dubied & Cie, Switzerland and designated the JDRPM machine. That machine employs a presser foot to push down the knitted loops in place of the usual take-down rollers which normally pull the knitted fabric away from the needles.

In carrying out the knitting procedure illustrated in FIG. 1, knitting is begun along a line 5 extending across the upper edge of each sleeve and across the upper shoulder line of the body. The first course knitted is a course of rib knitting using needles of both of the opposed needle beds. After knitting the first rib course, knitting is continued by knitting two single jersey fabrics 6 and 7, one on each of the opposed needle beds. Preferably, these fabrics are knitted contemporaneously, one or more yarn carriers supplying yarn to needles of one needle bed and one or more other yarn carriers supplying yarn to needles of the other bed. The fabrics 6 and 7 formed in this way together comprise fabric for the sleeves 8 and 9 and for the front and rear body shoulder regions 10 and 11 of the blank. Each course 12 is in fabrics 6 and 7 extends along the full length of each sleeve and across one or another of the body shoulder regions 10 and 11.

After completion of the sleeves 8 and 9 and of the body shoulder regions 10 and 11, and before casting off the fabrics 6 and 7, these fabrics may be joined along the underarm lines in the sleeves by courses 15, and 16 of rib knitting which extend from the arm pits 17 and 18 of the blank to the extremities 19 and 20 of the sleeves. This joining of the fabrics 6 and 7 is not, however, essential.

The next stage in the knitting procedure of FIG. 1 is the knitting of the body 21 of the garment blank. Preferably this is formed, as illustrated in FIG. 1, by knitting a tube having its wales 22 continuous with wales in the body shoulder regions 10 and 11 of the blank. The body 21 is thus knitted integrally with the fabric of the sleeves and body shoulder regions and if knitted as a tube requires no side seaming. If the body is knitted as two fabrics, one on each of the two needle beds, it will require seaming up the sides 23 and 24 to join the two fabrics together.

When the lower extremity 25 of the body is reached, the blank is cast off the needles and knitting of another blank may be commenced.

If desired, the body 21 may be shaped. For example a flare 26 may be introduced, as shown in broken lines in FIG. 1, by introducing new needles at the edges of the body fabric. The body can also be tapered by stitch transfer narrowing. The sleeves of the garment blank of FIG. 1 may be shaped by knitting on, after the start-up along the line 5, on needles in a central region only and thereafter in successive courses introducing additional needles at both ends of that central region to produce short courses in the upper neck region of the garment and successively longer courses as knitting progresses down the sleeves.

To make up the blank of FIG. 1 into a garment the sleeve fabrics are seamed together along the underarm lines, the cast-off rib courses being simultaneously cut away, and the lower extremity of the body is hemmed. A neck opening is also cut out and trimmed and if necessary seams are formed along the upper edge lines of the sleeves and across the upper shoulder line of the body and up the sides of the body.

In the procedure illustrated in FIG. 2, knitting is begun by knitting a rib course 31 on both needle beds of the machine and extending along the length of both sleeves 32 and 33 and across the width of the body 30 of the blank. Thereafter courses of single jersey knitting are formed on the rear needle bed of the machine commencing in the present instance with the course 34 at the rear of the garment blank and continuing with courses which extend the full length of each sleeve 32 or 33 and across the rear body shoulder region 35 of the blank. In the meantime, those loops of the first rib course 31 which were formed on the front needle bed are held on the needles which formed them and these needles are maintained inactive. When the course 36 is reached, lying along the upper edge line of each sleeve and across the upper shoulder line of the body, knitting is continued on the rear needle bed to knit the parts of each sleeve 32 or 33 which are presented to the front of the garment and to knit, at the same time, the front body shoulder region 37 of the garment blank. When the front parts of the sleeves and the region 37 are completed, the front and rear parts of the sleeves may be joined together temporarily by courses of rib knitting extending along the underarm line 38 or 39 of each sleeve from the extremity 40 or 41 of the sleeve to the arm pit 42 or 43. Whilst these rib courses are being knitted (if desired during the same traverse of the cam carriage) the needles holding loops of the garment body are maintained inactive, but in order to knit the rib courses along the lines 38 and 39 the previously inactive needles on the front bed of the machine holding loops of the first rib course 31 are brought back into knitting action.

After the formation of the rib courses along the lines 38 and 39, the cams of the machine are operated to cast off the stitches in these two rib courses. There then remain on needles of the rear bed the loops of the first rib course 31 located at the lower extremity of the rear body shoulder region 35 of the garment, and on needles of the front bed the loops of the last single jersey course of the front body shoulder region 37. Knitting is then continued on these loop-holding needles to form the body 30 of the garment as a tube and the blank is cast off the needles when the lower extremity 42 of the garment blank is reached.

The tubular knitting of the body may be effected by knitting along one needle bed and then in the opposite direction along the other, and so on. Other methods of forming a tube may also be used. For example, a front yarn carrier may be arranged to supply yarn to needles of the rear bed and a rear yarn carrier may be arranged to supply yarn to needles of the front bed as the carriers move along the needle beds one ahead of the other. After completion of these carrier movements, the carrier which led is arranged to be the leading carrier again for the next movement along the needle beds, this time in the opposite direction. The same carrier continues to lead in succeeding carrier movements and this, coupled with the arrangement of front and rear carriers supplying yarn to the opposite needle beds, causes the yarn to cross over and interlace at the edges of the two single jersey fabrics formed on the machine thus in effect forming a knitted tube. A further method of forming a tube, in which, as in the previously described method, the same yarn carrier always supplies yarn to the same needle bed, involves tucking or knitting yarn supplied to needle of one bed onto the needle holding the edge loop of the fabric being knitted on the other needle bed. This procedure is carried out at both edges of the two fabrics thus joining them at these edges and producing the tube.

The body tube can be flared by widening and narrowed by stitch transfer.

The garment of FIG. 2 is made up into a garment by seaming along the under arm lines or the sleeves, simultaneously cutting away any rib courses formed along those lines, and hemming the lower extremity of the body of the blank. A neck opening is also cut in the blank and trimmed.

It is not essential to form rib courses to join the front and rear sleeve fabrics temporarily along the underarm lines, since these fabrics may be left unjoined along these lines until the final seaming.

Both the garment blank of FIG. 1 and that of FIG. 2 may be knitted starting at the lower extremity of the body and knitting in the reverse direction to that described above to finish by completing the sleeve fabric of the blank.

What is claimed is:

1. In a method of knitting a blank for a sleeved garment wherein the sleeves of the blank are formed integrally with the body of the blank in the knitting process, the improvement comprising performing the following steps in either order:

(a) knitting fabric to constitute the sleeves and the front and rear body shoulder regions of the garment by forming knitted courses each of which extends the full length of each sleeve and across one of said body shoulder regions, (b) knitting body fabric for the blank by forming simultaneously front and rear body portions of the blank by knitting courses which extend across said body portions in the finished garment, (c) said body fabric being integral with said sleeve and body shoulder region fabric and having knitted wales which are continuous with knitted wales in said front and rear body shoulder regions.

2. A method according to claim 1, wherein step (*a*) is carried out first and;

(d) knitting is commenced with a course of rib knitting formed on opposed needle beds and intended to lie, in the finished garment, along the upper edge line of each sleeve and across the upper shoulder line of the body, (e) knitting is continued by forming a piece of fabric independently on each of said opposed needle beds, said independently formed pieces of fabric constituting respectively a front portion of each sleeve and the intermediate front body shoulder region, and a rear portion of each sleeve and the intermediate rear body shoulder region, and (f) knitting is further continued by knitting the main part of the garment body comprising said front and rear body portions of 1(*b*) by knitting in the form of a tube on said opposed needle beds in continuation of wales of said body shoulder regions.

3. A method according to claim 1, wherein step (*a*) is carried out first and;

(g) knitting is commenced along a line extending along the underarm of each sleeve and across the body of the blank at the same level and is carried on to form in either order (1) a front portion of each sleeve and the intermediate front body shoulder region, and (2) a rear portion of each sleeve and the intermediate rear body shoulder region, and (h) knitting is continued by knitting the main part of the garment body comprising said front and rear body portions of 1(*b*) by knitting in the form of a tube in continuation of wales of the last knitted of said front and rear body shoulder regions.

4. In a blank for a sleeved garment wherein sleeves and body of the blank are integral parts of the same piece of knitted fabric, the improvement that the blank comprises;

(i) fabric constituting the sleeves and the front and rear body shoulder regions of the garment and having knitted courses each of which extends the full length of each sleeve and across one of said body shoulder regions, and (j) body fabric integral with said fabric of (*i*) above, knitted in tubular form, constituting front and rear body regions of the garment, and having knitted wales continuous with wales of said front and rear body shoulder regions.

5. A blank according to claim 4 wherein (k) front and rear portions of the sleeves are joined to one another and said front and rear body shoulder regions are joined to one another by a course of rib knitting extending along the upper edge line of each sleeve and along the upper shoulder line of the body, and wherein (l) said tubular body fabric of 4(*j*) is integrally joined with both said front body shoulder region and said rear body shoulder region.

6. A blank according to claim 4 wherein (m) one only of said front and rear body shoulder regions is integrally directly joined with said tubular body fabric of 4(*j*).

* * * * *